United States Patent [19]

Piscetta

[11] Patent Number: 4,882,973

[45] Date of Patent: Nov. 28, 1989

[54] MULTIPLE FUNCTION COMBINED WEAPON

[76] Inventor: Armando Piscetta, Via delle Fornaci, 4 -- 17025, Loano (Savona), Italy

[21] Appl. No.: 200,835

[22] Filed: Jun. 1, 1988

[30] Foreign Application Priority Data

Jun. 2, 1987 [IT] Italy ..... 20762 A/87

[51] Int. Cl.[4] ..... F41C 21/06

[52] U.S. Cl. ..... 89/1.41

[58] Field of Search ..... 89/1.41, 126, 127; 42/105, 106, 1.09, 1.08, 42.02

[56] References Cited

U.S. PATENT DOCUMENTS

| | | | |
|---|---|---|---|
| 1,029,469 | 6/1912 | Schrodel | 42/105 |
| 1,337,327 | 4/1920 | Rockwell | 89/1.41 |
| 1,360,443 | 11/1920 | Robertson et al. | 42/106 |
| 1,563,438 | 12/1925 | Russel et al. | 89/127 |
| 2,436,175 | 2/1948 | Neal | 89/127 |
| 2,935,915 | 5/1960 | Janson | 89/126 |
| 3,279,114 | 10/1966 | Lewis et al. | 42/105 |
| 3,641,691 | 2/1972 | Ellis et al. | 42/105 |
| 3,854,231 | 12/1974 | Broyles | 89/1.41 |
| 4,291,479 | 9/1981 | Lough | 42/105 |

FOREIGN PATENT DOCUMENTS

| | | | |
|---|---|---|---|
| 2549734 | 5/1977 | Fed. Rep. of Germany | 42/105 |
| 1347952 | 11/1963 | France | 42/106 |
| 412580 | 6/1934 | United Kingdom | 42/1.08 |
| 2026658 | 2/1980 | United Kingdom | 89/1.41 |

OTHER PUBLICATIONS

JCMI (J. C. Manufacturing Inc.), Product Improved M-203 40 mm. grenade launcher system, 10/15/86.

*Primary Examiner*—Deborah L. Kyle
*Assistant Examiner*—Stephen Johnson
*Attorney, Agent, or Firm*—Bucknam and Archer

[57] ABSTRACT

The present invention relates to a multiple function combined weapon, adapted to be used in different uses, characterized in that it comprises a weapon body, supporting a first shot gun or rifle barrel, of reduced length, with the magazine arranged in the central portion of the body. Under the first barrel a second barrel is arranged, of a machine gun type of weapon, the magazine of which is arranged at the front portion of the body. Between the two magazines two triggers are provided which can be actuated for a selective firing, either with the top barrel or with the bottom barrel.

6 Claims, 1 Drawing Sheet

MULTIPLE FUNCTION COMBINED WEAPON

BACKGROUND OF THE INVENTION

The present invention relates to a multiple function combined weapon, which can be used in different ways.

As is known, armed and police forces of several Countries have presently felt a need of using semi-automatical or manual repetition guns, provided with smooth barrels and of several bores.

These types of guns, which have generally reduced length barrels (of about 400–450 mm) usually fire particular cartridges including rubber balls, or able to launch lachrymatory substances.

These guns, as is known, which can be handled in a very easy way and have a very small operating range of about 30 m, have been selected since, within a short distance, the shot is facilitated, particularly in dark or closed environments.

On the other hand such a gun, because of its limited range, necessarily requires further protection and for this reason each man bearing such a weapon is protected, usually, by another man bearing an automatic or rifled barrel weapon able of greater ranges.

Thus, because of the above mentioned security reasons, two men must be practically used in police and the like operations, which represents a drawback.

SUMMARY OF THE INVENTION

Accordingly, the task of the present invention is to overcome the above mentioned drawback by providing a novel type of combined weapon which has the features of conventional weapon presently used by two persons.

Within the scope of this task, a main object of the present invention is to provide such a multiple function combined weapon which can be handled in a very easy way while having a very reduced weight with respect to known weapons.

Another object of the invention is to provide such a combined weapon which is very safe in operation and which can be easily made starting from easily commercially available elements and which, moreover, is very advantageous from a mere economic standpoint.

According to one aspect of the present invention, the above mentioned task and objects, as well as yet other objects which will become more apparent hereinafter, are achieved by a multiple function combined weapon, adapted to be used in different uses, characterized in that it comprises a body supporting a first gun barrel, of reduced length, with the magazine being arranged at the central portion of said body.

Under the first gun barrel a second barrel is arranged, like a machine gun barrel, the magazine of which is arranged at the front portion of said body.

Between the mentioned magazines there are provided two triggers which can be actuated for a selective firing, either from the top barrel or from the bottom barrel.

BRIEF DESCRIPTION OF THE DRAWINGS

Further charactaristics and advantages of the present invention will become more apparent hereinafter from the following detailed description of a preferred, though not exclusive, embodiment of a multiple function weapon according to the invention, which is illustrated, by way of an indicative but not limitative example, in the accompanying drawing, in which.

DESCRIPTION OF THE PREFERRED EMBODIMENT

With reference of the sole figure of the accompanying drawing, the multiple function combined weapon according to the present invention which is overally indicated at the reference number 1, comprises a body 2 thereto a first barrel 3 is coupled so as to practically provide a small size gun or rifle, which can consist of a conventional manual repetition gun, or "pump" gun in which the barrel 3 is supplied with cartridges from a first magazine 4 which is arranged at the central portion of the body 2 of the weapon.

Figure 1:
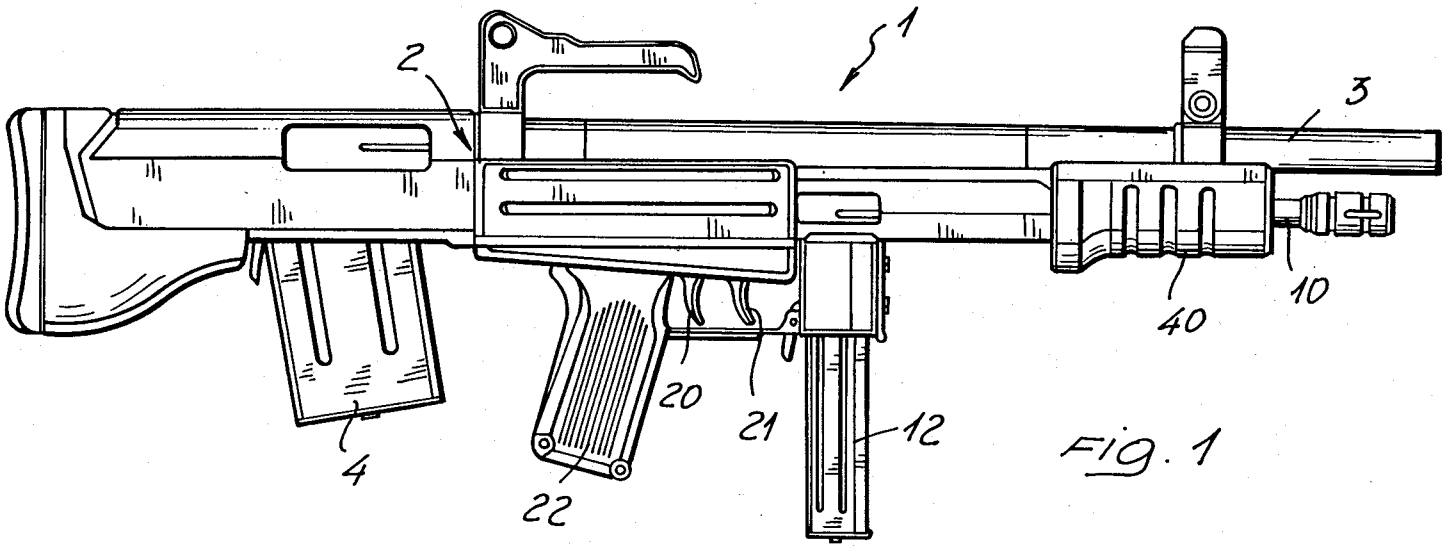
FIG. 1 is a schematic elevation view illustrating the multiple function combined weapon according to the present invention.
Figure 3:
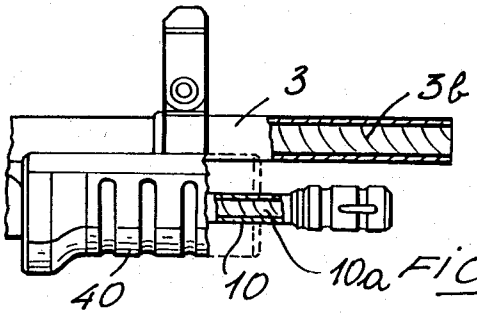
FIG. 3 is another detail partial view, partially longitudinally sectioned, showing the two barrels of the subject weapon, both having inner rifled surfaces.
Figure 2:
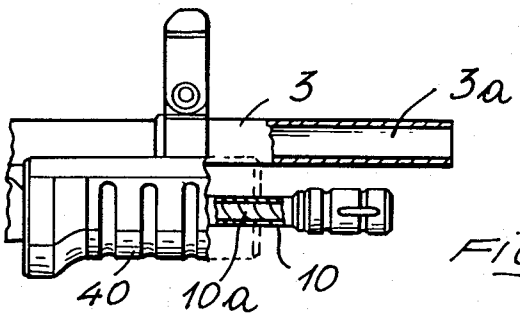
FIG. 2 is a detail partial view, partially longitudinally sectioned, showing a first barrel of the weapon having a smooth inner surface and a second barrel of the weapon having a rifled inner surface.

This weapon, the barrel 3 of which is preferably, though not necessarily, a smooth type of barrel (as shown at **3*a* in FIG. 2), is a conventional weapon or shot gun. Alternatively the first barrel 3 may be formed with a rifled inner surface as shown at 3*b* in FIG. 3**.

The main feature of the present invention is that under the first barrel, and extending with a parallel relationship thereto, there is arranged a further barrel 10, preferably of the rifles type (as shown at **10*a* in FIGS. 2 and 3**), which forms a portion of an automatic or semiautomatic weapon, which can be called "machine gun", and which, preferably can have a bore No. 9, or any other types of bores.

This second barrel 10, as shown, is supplied with cartridges by means of a second magazine 12 which is arranged at the front portion of the body 2 of the weapon.

Between the mentioned magazines 12 and 4 there are respectively provided a first trigger 20 and a second trigger 21 which are arranged near the handle 22 in turn arranged at the bottom front portion of the body 2, between the two magazines.

More specifically the triggers 20 and 21 can be selectively actuated so as to independently fire either a barrel or the other barrel so as to provide, with a single weapon, the two functions which are presently performed by two separate and distinct weapons.

The subject weapon is moreover provided with two safety devices and, in order to operate the pump gun it is necessary to withdraw the front arming small rod 40.

From the above disclosure, it should be apparent that the invention fully achieves the intended task and objects.

In particular the fact is to be pointed out that a very flexible and compact weapon has been provided which provides the user with both small and great range capabilities.

Moreover, the particular arrangement of the weapon handle between the two magazines afford good balancing and stability characteristics, with a small weight of the combines weapon.

The invention as disclosed is susceptible to several modifications and variations all of which will come within its spirit and scope.

Moreover all of the details can be replaced by other technically equivalent elements.

In practicing the invention, the used materials, provided that they are compatible to the intended use, as well as the contingent shapes and size can be any according to requirements.

I claim:

1. A multiple function combined weapon for firing different types of ammunition, said multiple function combined weapon comprising a body supporting a first shot gun barrel, a first magazine for loading said first shot gun barrel arranged at a central portion of said body, under said first barrel there being arranged a second barrel for an automatic weapon, a second magazine for loading said second barrel, said second magazine being arranged at a front portion of said body, between said first and second magazines there being provided two triggers selectively actuated for firing said first barrel by one trigger of said two triggers and for firing said second barrel by another trigger of said two triggers.

2. A combined weapon according to claim 1, wherein said second barrel is a rifled barrel.

3. A combined weapon according to claim 1, wherein said first barrel is smooth.

4. A combined weapon according to claim 1, wherein said first barrel is rifled.

5. A combined weapon according to claim 1, comprising a handle arranged between said first and second magazines.

6. A combined weapon according to claim 1, wherein said two triggers are arranged at a front of said handle.

* * * * *